United States Patent [19]

Pearce

[11] Patent Number: 4,827,608

[45] Date of Patent: May 9, 1989

[54] APPARATUS FOR ASSEMBLING TWO-PART CONNECTORS

[75] Inventor: Howard R. Pearce, London, England

[73] Assignee: Thomas & Betts Corporation, Bridgewater, N.J.

[21] Appl. No.: 19,830

[22] Filed: Feb. 27, 1987

Related U.S. Application Data

[62] Division of Ser. No. 765,604, Aug. 14, 1985.

[30] Foreign Application Priority Data

Aug. 17, 1984 [GB] United Kingdom ..... 8420977

[51] Int. Cl.[4] ..... B65D 85/42

[52] U.S. Cl. ..... 29/809; 206/332

[58] Field of Search ..... 206/330, 328, DIG. 820, 206/332 X, 334, 338; 221/79, 81; 29/809

[56] References Cited

U.S. PATENT DOCUMENTS

| | | | |
|---|---|---|---|
| 2,613,432 | 10/1952 | Gilbert | 29/748 X |
| 3,152,390 | 10/1964 | Floyd, Jr. | 29/811 X |
| 3,264,860 | 8/1966 | Herb | 29/748 X |
| 3,292,236 | 12/1966 | Busler et al. | 29/33.5 |
| 3,430,809 | 3/1969 | Vanstrom | 206/328 X |
| 3,443,683 | 5/1969 | Felty, Jr. et al. | 206/820 X |
| 3,444,993 | 5/1969 | Lunsford | 206/330 |
| 3,710,610 | 1/1973 | McCaughey | 29/751 X |
| 3,797,655 | 3/1974 | Boone et al. | 206/330 |
| 4,020,540 | 5/1977 | Casciotti et al. | 29/749 |
| 4,286,381 | 9/1981 | Litehizer, Jr. | 29/751 |
| 4,332,083 | 6/1982 | Johnson, Jr. et al. | 29/749 |
| 4,361,942 | 12/1982 | Mazzola et al. | 29/748 X |
| 4,393,580 | 7/1983 | Hall, Jr. | 29/749 |
| 4,481,710 | 11/1984 | Caveney et al. | 29/749 |
| 4,488,353 | 12/1984 | Caveney et al. | 29/749 |
| 4,517,718 | 5/1985 | Johnson, Jr. | 29/748 X |
| 4,525,927 | 7/1985 | Guerout et al. | 29/861 |
| 4,549,343 | 10/1985 | Grubb et al. | 29/33 |
| 4,554,733 | 11/1985 | Caveney | 29/749 |
| 4,633,370 | 12/1986 | Hamuro et al. | 206/330 X |
| 4,706,812 | 11/1987 | Spinelli et al. | 206/332 |

FOREIGN PATENT DOCUMENTS

| | | | |
|---|---|---|---|
| 167620 | 5/1956 | Australia | 29/33 F |
| 8303033 | 9/1983 | PCT Int'l Appl. | 29/748 |

OTHER PUBLICATIONS

Panduit "LAT—CON® System", Bulletin LAT—CON—1, Copyright 1983, 8 pages.

*Primary Examiner*—Timothy V. Eley
*Assistant Examiner*—Joseph M. Gorski
*Attorney, Agent, or Firm*—Robert M. Rodrick; Salvatore J. Abbruzzese

[57] ABSTRACT

Apparatus for assembling a two-part connector with an interposed cable, which apparatus comprises a pair of relatively movable press elements, storage structure for containing a plurality of connectors, structure for moving a connector from the magazine to an operative position between the respective press elements, structure for actuating at least one of the press elements to achieve crimping of the connector and an interposed cable, when the connector is in the operative position, and control apparatus for selectively causing indexing of the storage structure, movement of a connector into the operating position and crimping movement of the press elements.

4 Claims, 7 Drawing Sheets

Fig. 6D.
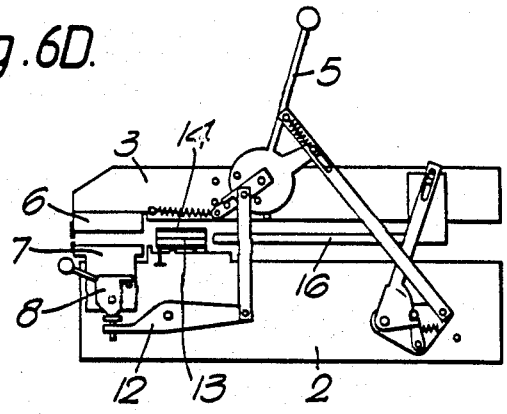
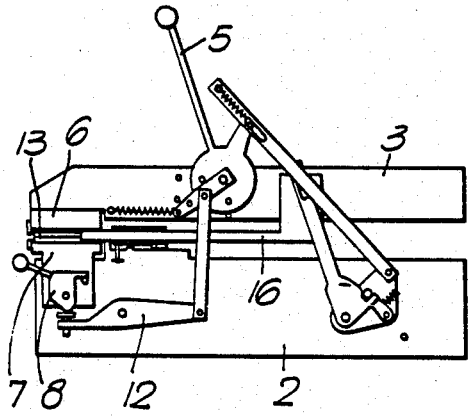
Fig. 6E.
Fig. 6F
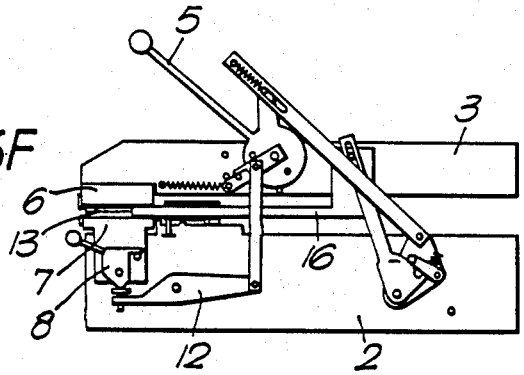
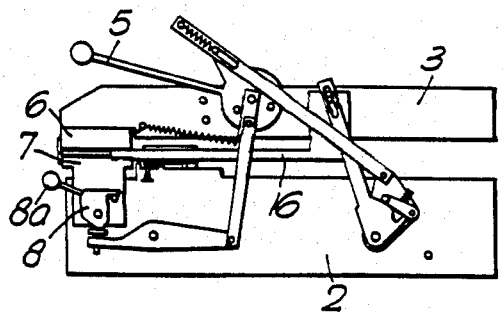
Fig. 6G.

APPARATUS FOR ASSEMBLING TWO-PART CONNECTORS

This is a division of application Ser. No. 765,604, filed Aug. 14, 1985.

BACKGROUND OF THE INVENTION

1. Field of the Invention

This invention relates to an apparatus for assembling two-part connectors. In particular, the invention relates to an apparatus for connecting two-part multiple plug and socket connectors to a multiple core strip cable.

2. Description of the Prior Art

It is known to provide a cable in the form of a flat strip or ribbon in which a plurality of insulated conductors are arranged in side by side configuration. A wide variety of multiple plug and socket connectors are known for use with such cables. Generally the connectors have a plurality of contacts, one positioned to correspond with each of the conductors in a strip cable, and connection to the strip is made by causing the contacts to move into connection with a respective conductor of the cable by displacing the insulating material surrounding the conductor. Such connectors are known as insulation displacement contact connectors or IDC connectors. Typically, IDC connectors have a lower body portion, that may, for example form a plug for cooperation with a socket, and an upper cap portion. In the assembly of such connectors with a ribbon cable, the cable is appropriately positioned between the upper and lower connector portions which are subsequently brought towards one another, this movement causing the contacts to make connection with the conductors of the cable, by displacing insulating material, and, in a final position, to grip the cable firmly within the connector.

Assembly of such a connector/cable arrangement is typically an essentially manual operation which is time consuming and unreliable. Apparatus has been proposed to mechanise the final clamping of the connector to a cable, for example using a pneumatic press. The use of such presses still requires manual assembly of the connector in relation to a cable.

SUMMARY OF THE INVENTION

It is an object of the invention to provide an improved apparatus for the assembly of two-part connectors.

Accordingly, the invention provides apparatus for assembling a two-part connector with an interposed cable, which apparatus comprises a pair of relatively movable press elements, storage means for containing a plurality of connectors, means for moving a connector from the magazine to an operative position between the respective press elements, means for actuating at least one of the press elements to achieve crimping of the connector and an interposed cable, when the connector is in the operative position, and control means for selectively causing indexing of the storage means, movement of a connector into the operating position and crimping movement of the press elements.

BRIEF DESCRIPTION OF THE DRAWINGS

In order that the invention may be more readily understood, and so that further features thereof may be appreciated, an embodiment of an apparatus of the invention will now be described, by way of example, with reference to the accompanying drawings, in which:

FIGS. 4A to L illustrates schematically the operating faces of the apparatus;

FIG. 6A to L illustrates one preferred operation and control means for the invention.

DESCRIPTION OF PREFERRED EMBODIMENTS

Figure 1:
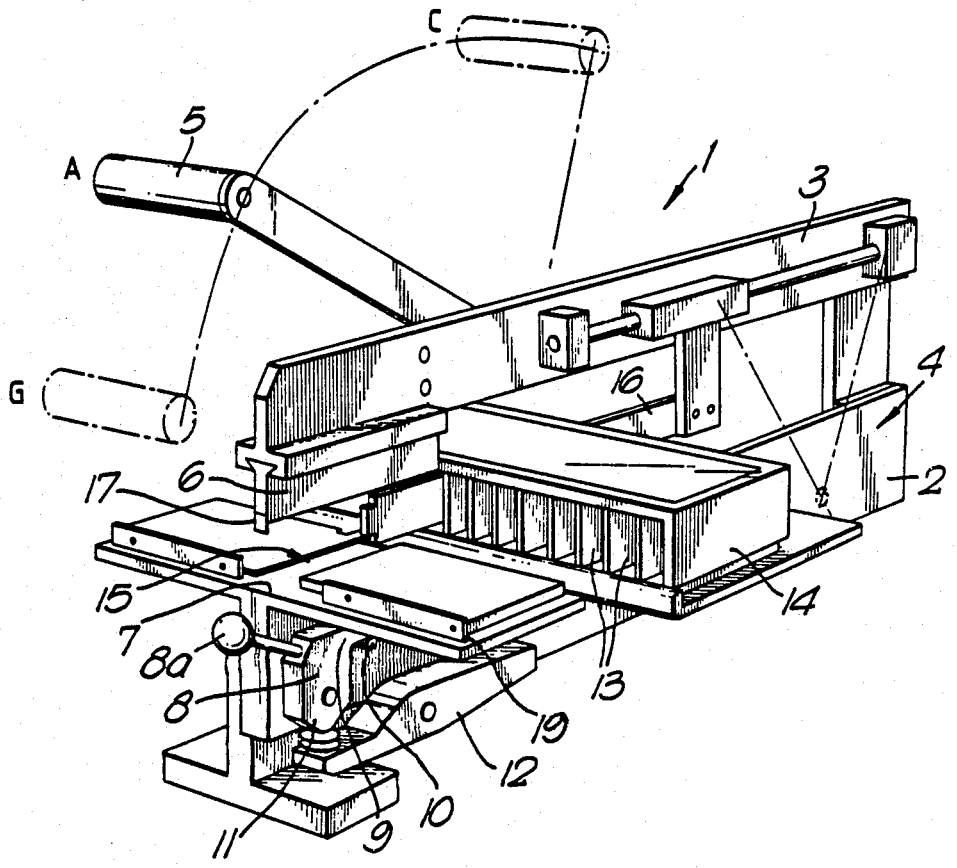
FIG. 1 is a perspective view of an apparatus of the invention.

Referring to FIG. 1 an apparatus embodying the invention is generally indicated at 1. The apparatus 1 comprises a lower support member 2 and an upper press member 3. The press member 3 is held in a fixed position relative to the support member 2. Operation of the apparatus is achieved by actuation of a control means generally indicated 4, one form of which will be described in detail hereinbelow. The control means 4 includes an operating handle 5.

At a forward end, the apparatus 1 has upper and lower press elements 6, 7 respectively. The upper press element 6 is fixedly connected to, the member 3 and projects downwardly towards the support member 2. The lower press element 7 is positioned at an outer upper end region of the support member 2 and defines an upwardly facing anvil for cooperation with the press element 6. The lower press element 7 cooperates with the support member 2 but is movable in a substantially vertical direction with respect thereto from an operating position, as shown in FIG. 1, to an upper crimping position, best seen in FIG. 6*g*, and to a lower clearance position best seen in FIG. 6l. The relative position of the press element 7 is controlled by a pivoting element 8 having a projection 9 that cooperates with a support pin 10 connected to the element 7. In its lower region, the pivoting element 8 presents a cam surface 11 that cooperates with an arm 12 of the control means 4. The element 8 is normally maintained in an upright position, as shown in FIG. 1. The arm 12 is pivotable so that, on appropriate movement of the control means 4, the end of the arm 12 that cooperates with the lower region of the element 8 is moved upwardly, causing the element 8 and thus the press element 7 to move from the operative position to the crimping position. The element 8 may be pivoted, using a handle 8*a*, to a second, inclined, position the cooperation between the cam surface 11 and the arm 12 allowing the element 7 to move in a downward direction to the clearance position.

A connector storage and feed mechanism is positioned between the members 2 and 3 and is operative to feed connectors 13 from a magazine 14 to the operative position, indicated 15, between the press elements 6 and 7.

Figure 2:
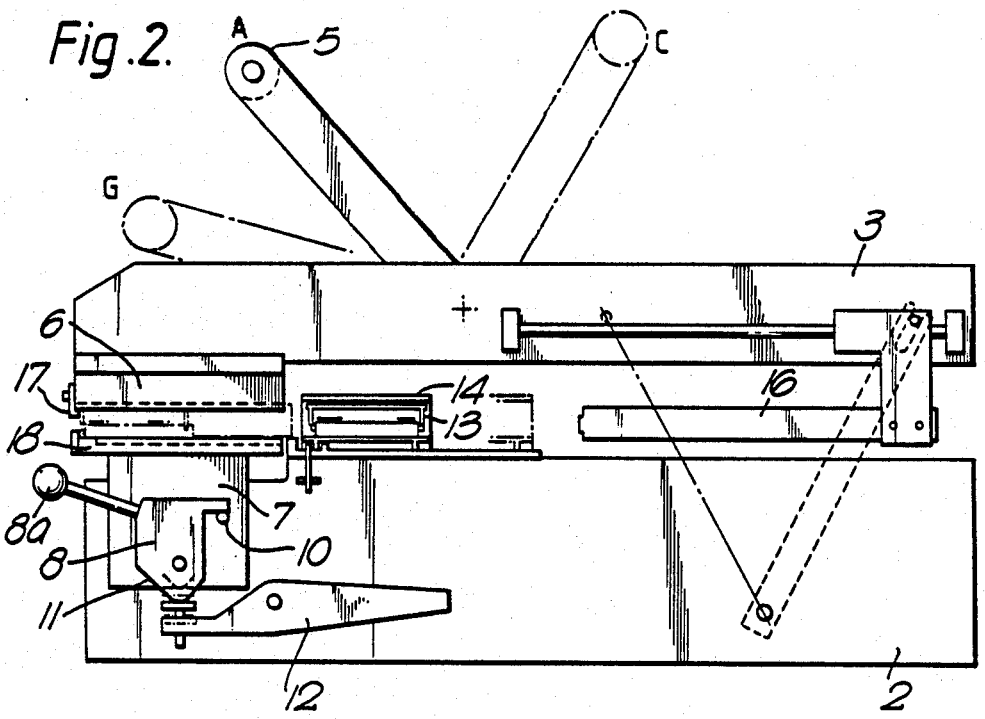
FIG. 2 is a side elevation of the apparatus of FIG. 1.

The connectors 13 are held within the magazine 14 in a connected but spaced-apart arrangement that enables a ribbon cable to be fed between the spaced apart elements before these are clamped to achieve the desired connection. A sliding ram 16, that is operated by the control means 4, is operative to move a selected connector 13 out from the magazine 14 into the operative position 15. As best seen in FIG. 2, a stop plate 17 projects downwardly from an outer end face of the press element 6 to limit movement of the connector 13 and thus to position the connector 13 for clamping in the operating region 15. When the sliding ram 16 urges a connector 13 towards and into engagement with the end plate 17 the connector is locked in position by cooperation between the end plates 17 and the ram 16.

Figure 3:
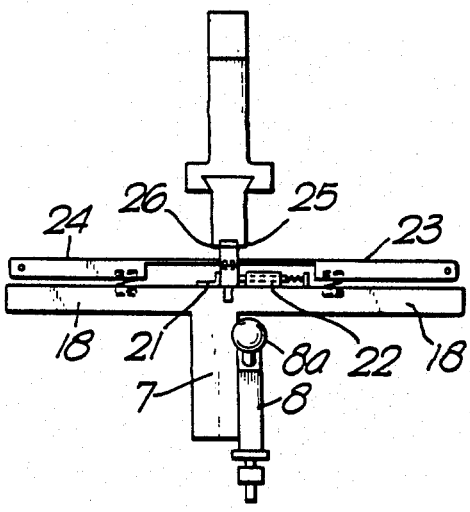
FIG. 3 is an end elevation of the apparatus of FIG. 2.

As best shown in FIG. 3, the lower press element 7 comprises support plates 18, that extend outwardly to form a substantially T-section element. The plates 18 provide support and guidance for a ribbon cable to be inserted between the upper and lower parts of a connector 13 when this is in the operative position 15, and, additionally, edge guides 19 project upwardly from an upper surface of the rings 18 to facilitate correct positioning of the cable. It will be appreciated that by appropriate positioning of the edge guides 19 (FIG. 1) and the end plate 17 correct alignment of the ribbon cable with a connector 13 can be achieved, irrespective of the width of the connector and cable.

Referring again to FIG. 3, a lower retaining means comprising a fixed side stop 21 and a spring biassed clamp 22, acts to retain the lower connector body in fixed relation to the upper cap part. Spring biassed plates 23, 24 are positioned on the upper surface of the plates 18, on either side of the operative position 15. When a cable is in position and the lower press element 7 is moved towards the upper press element 6 the plates 23, 24, cooperate with depending projections 25, 26 of the press element 6 to flatten and hold the cable in the correct orientation.

Figure 4A:
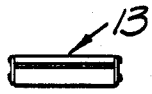
FIGS. 4*a, b* and *c* illustrate various stages in the assembly of the connector.
Figure 4B:
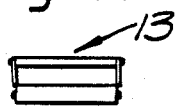
Figure 4C:
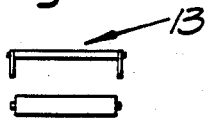

Referring to FIGS. 2, 4 4a and 4b operation of the apparatus will be described briefly. As described in detail later, the operation of the handle 5, causes the sliding ram 16 to move a connector 13 from the magazine 14 to the operative position 15, where it is held by cooperation with the forward end of the ram 16 and the depending end plate 17. This position is indicated in the dotted lines in FIG. 2. A flat ribbon cable is then fed between the spaced apart upper and lower portions of the connector and when this has been appropriately positioned, the handle 5 is operated to cause the press element 7 to move towards the press element 6 and thus to move the upper part of the connector 13 from its insertion level, as shown in FIG. 4*b*, to the crimping position as shown in FIG. 4*a*. Further operation of the handle 5 releases the crimped connector 13 following which the press element 7 is lowered allowing the crimped connector and cable to be removed easily from the apparatus.

In situations where the ends of the ribbon cable are obstructed, for example by another previously positioned connector, and thus the cable cannot be fed through the connector 13 in its spaced apart but connected arrangement, the apparatus provides a further operating step to allow the two parts of the connector to be separated to permit a cable to be inserted between the respective connector parts in a transverse direction. To achieve this operation a connector is moved into the operative position 15 as in the previously described operation. In this position the upper part of the connector is held fixed by the ram 16 and the plate 17 whilst the lower part is firmly held by the side plate 21 and spring retaining means 22. Prior to the crimping operation, and with the two parts fixed as described, operation of the pivot element 8 to move the press element 7 downwardly causes a separation of the connector parts allowing insertion of the ribbon cable. When the cable is appropriately positioned the element 8 is again actuated to move the press element 7 back to its operative position. It should be appreciated that as the upper and lower parts of the connector 13 are gripped separately and the apparatus parts are constrained to move in fixed directions, correct alignment of the upper and lower parts will be maintained during the separation and reconnection phases. The cable can be correctly aligned using the edge guides 19 and the connector and cable can be crimped together as described above.

Figure 5:
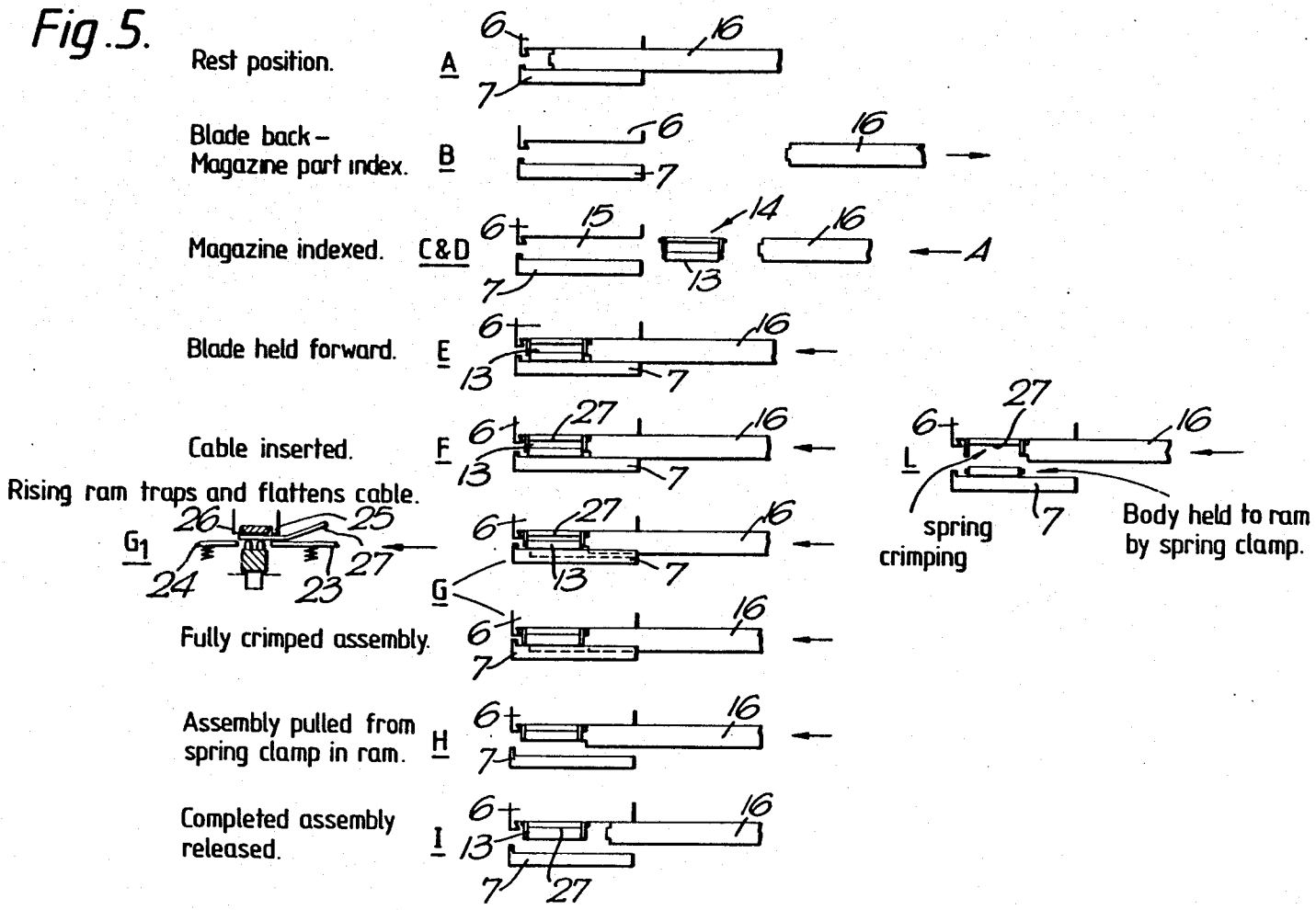

FIG. 5 shows schematically various stages in the operation. In position A the apparatus is in a rest position with the sliding ram positioned between the press element 6 and 7 but with no connector in position. The various stages A to L correspond to different movements of the handle 5 of the control means to achieve relative movements of various elements of the apparatus.

At B the sliding ram is moved out from between the press elements and this is followed by indexing of the connector magazine 14 to bring a connector 13 into alignment with the ram 16 so that forward movement of the ram, as indicated by the arrow A, will move the ram into cooperation with a connector 13 to move this out of the magazine and towards the operative position 15 between the press element 6, 7. As shown at E the ram 16 is held in its forward position to clamp the upper part of the connector 13 in the operative position. Continuing to F, a ribbon cable 27 is then fed between the upper and lower parts of the connector 13. Alternatively, if the cable 27 is to be fed transversely into the connector 13 the lower press element 27 is moved downwardly, as described above, to separate the connector elements and allow insertion of the cable 27 (step L). The handle is then moved towards postion G in which the connector parts are crimped together to form the connector/-cable assembly. As indicated in FIG. G1, movement of the press elements towards each other causes the plates 23, 24 to engage with shoulders 25, 26 of the element 6 thus flattening the cable before crimping occurs. This ensures correct alignment of respective conductors with a corresponding contact. The lower press element 7 is then moved downwardly whilst the assembled connector is held in position by the cooperation of the ram 16 and the front plate 17 (step H) and subsequent rearward movement of the ram 16 allows the assembled connector/cable to be removed from the apparatus.

FIG. 6 shows in detail one convenient form of control means 4. Referring firstly to FIG. 6*a*, 6*b*, the control means 4 comprises the handle element 5 that is connected to a crank 28 by a suitable slipping friction clutch. Connected to a crank 28, to control movement thereof, is a spring biassed lever 29, that is connected at its outer end to the upper member 3 by a spring 30. The connecting rod 31 connects the crank 28 with one end of the pivoting rod 12, the other end of which cooperates with the element 8, to achieve the desired movement of the press element 7. The rod 12 is pivotally connected with the lower support member 2 by a pivot 32.

A swivel plate 33, that is substantially triangular in shape, is rotatably mounted towards the rear of the support member 2, a pin 34 being provided to limit the carrier movement of the plate 33. The drive element 35 connects the plate 33 with the sliding ram 16. The drive element 35 being pivotally connected to the plate 33 at one end, and having at its other end a slot that receives a pin projecting downwardly of the sliding ram 16. A spring pawl 36 cooperates with the lower end of the drive element 35 to control movement thereof. For this purpose, the lower end of the drive element is profiled to present a cam surface 37 that cooperates with the spring pawl 36 to achieve control movement of the sliding ram 16 upon rotation of the plate 33. The plate 33 is connected to the handle element 5 by a connecting rod 38. The connecting rod 38 is pivotally connected at one end to the plate 33 and has a slot 39 towards its other end that receives a pin that projects it from an extension of the handle element 5, the pin 40 being urged towards the top of the stop 39 by a spring 41.

Connecting means (not shown) are also provided between the control means 4 and an indexing mechanism for the magazine 14 so that appropriate movement of the handle 5 causes first a magazine pawl 42 to retract followed by indexing of the magazine 14. Relative movements of the elements of the control means is controlled by appropriately positioned stops, as illustrated in the Figures.

Figure 6A:
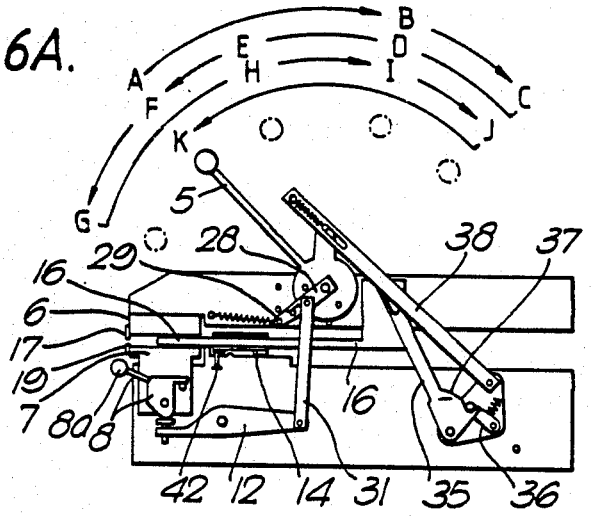
Figure 6B:
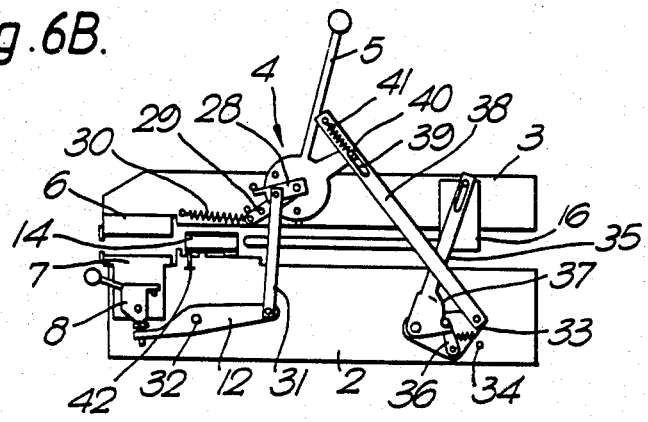
Figure 6C:
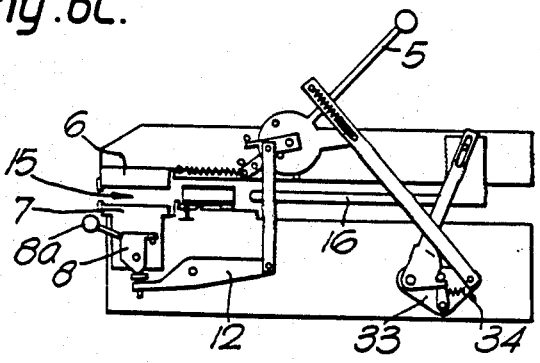
Figure 6H:
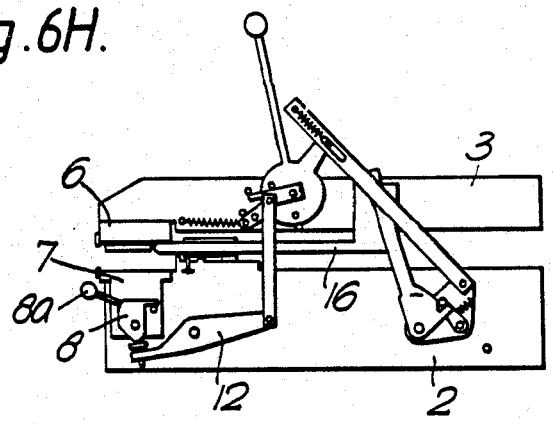
Figure 6I:
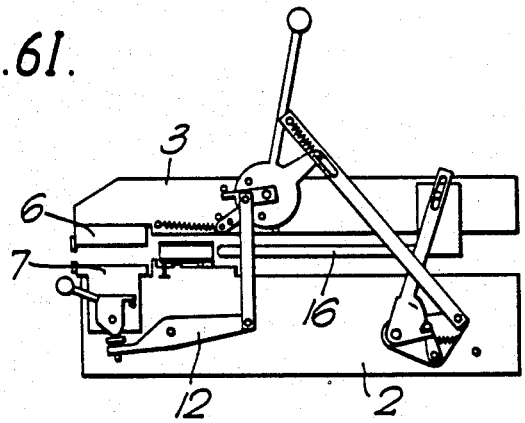

Operation of the control means will be best appreciated by consideration of FIGS. 6*a* to *l*, the reference letters corresponding to movement positions of the handle 5, as illustrated in FIG. 6*a*. The reference letters used in FIG. 6 correspond to those used when describing the general operation of the apparatus with reference to FIG. 5.

When the handle is in position A the apparatus is in its rest position. Movement of the handle to position B causes the sliding ram 16 to move away from its rest position and clear of the magazine 14. As soon as the ram 16 is clear of the magazine 14 the magazine pawl 42 begins to retract and the press element 7 moves to its lower clearance level. Movement of handle to position C causes full retraction of the magazine pawl and subsequent movement of the handle to position D causes indexing of the magazine to bring a connector into alignment with the ram 16. At this time the press element 7 is returned to its upward position and the crank 28 is restrained from further movement by a stop pin on the crank pin lever 29.

Movement of the handle 5 to postion E causes the sliding ram 16 to move a connector 13 into the operative position to abut the end plate 17 and the spring pawl 36, of the plate 33, is caused to move up the cam face 37 thus urging the sliding ram against the connector 13 to hold this in the desired position. As the handle is moved to position F (the rest position) the action of the spring pawl 36 against the cam face 37 acts to retain pressure on the sliding ram 16 and thus to retain the connector 13 in the desired position. In this position a ribbon cable (not shown) is fed into the gap between the connector parts. Subsequent movement of the handle to position G causes the rod 12 to pivot, moving its outer end upwardly and thus causing the lower press element 7 to be raised towards the press element 6 and thus to achieve crimping of the connector and cable.

Return movement of the handle to position H moves the press element 7 towards its clearance position whilst maintaining pressure on the ram 16 to retain the crimped connector 13 in position between the ram 16 and the end plate 17. Further movement of the handle to position l causes retraction of the sliding ram 6 allowing removal of the assembled cable and connector from the apparatus.

Figure 6L:
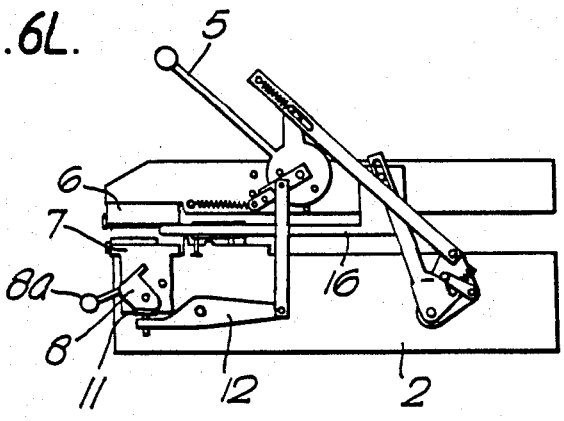

As explained, the apparatus is also useful for transverse, or mid-span, assembly of a connector and a cable. To achieve such assembly the above described steps are conducted up to handle position F, at which time, with the upper connector part held firmly between the ram 16 and end plate 17, the element 8 is rotated, cooperation between the rod 12 and the cam face of the element 8 allowing the element 8, and the press element 7, to move downwards to the clearance position. As the lower cable part is held firmly in position on the lower press element 7, the connector parts are moved apart allowing transverse insertion of the cable. This is illustrated in FIG. 6L. When the element 8 is returned to its original position the crimping steps achieve to L are carried out.

Any other convenient control means may be used. For example a pneumatic arrangement for achieving the desired movement of the press elements and indexing of the connector magazine could be used. Operation may be manual or automatic.

Figure 7A:
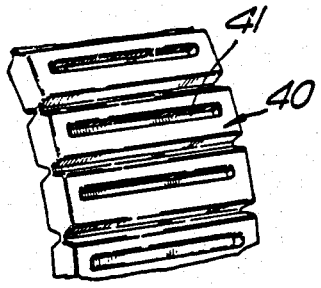
FIGS. 7 to 10 illustrate a variety of alternative connector supply arrangement for use with the apparatus of the invention.
Figure 7B:
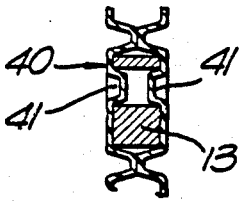
Figure 8:
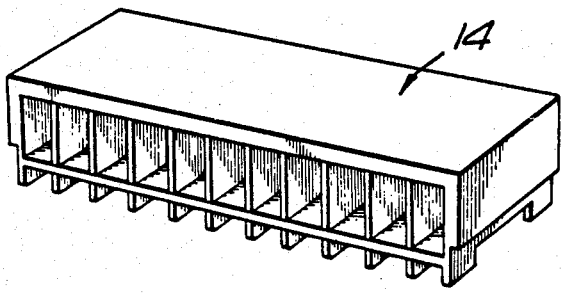
Figure 9:
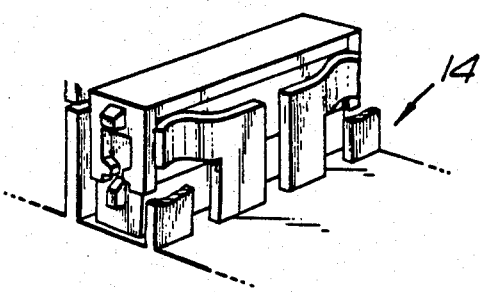
Figure 10:
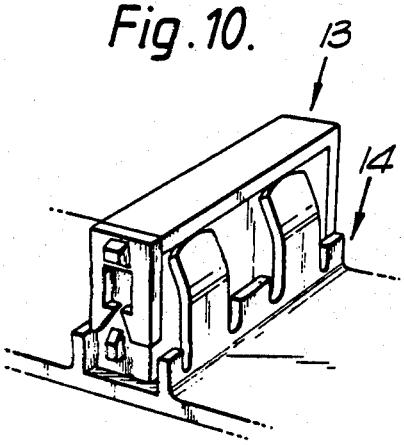

FIG. 7 to 10 illustrates the variety of forms of suitable magazines for retaining a store in connectors. As shown in FIG. 7A and B the connectors may be contained in a flexible bandolier or, as shown in FIG. 8, the connectors may be positioned in a magazine rack.

Whilst the embodiment illustrated in FIGS. 1 to 6 shows an arrangement of the apparatus suitable for use with a magazine rack containing connectors 13 it will be appreciated that only minor modifications to the described arrangement are required to enable the use of a flexible bandolier, such as that illustrated in FIG. 7. In order that the connectors are presented in the desired upright configuration appropriate access apertures may be provided in the members 2 and 3 to allow substantially vertical feed of the bandolier through the apparatus.

Considering the bandolier arrangement of FIG. 7, it will be seen that connectors 13 are spaced from each other in a semi-rigid plastics film, each connector being held in a distinct-envelope part 40 of the bandolier. The ends of each envelope part 40 are open to allow the connector 13 to be moved from the bandolier to the operative position of the apparatus by the sliding ram 16. A dimpled area 41 projects inwardly from each side of each envelope part and acts to retain the desired separation between the connector parts. The bandolier may conveniently be provided in short strips or in longer lengths, for example in a roll. Any suitable indexing means, associated with the control means 4 may be used to sequentially bring connectors into alignment with the ram 16.

Whilst suitable for use alone, apparatus of the invention may advantageously be used in combination with an automatic cable cutting machine. For example, in one particularly preferred arrangement a cable cutter and clamp means are associated with the apparatus for cutting predetermined lengths of cable. In such an arrangement (not shown) a cable cutter is positioned on one side of the press elements and a cable clamp is positioned on the opposite side of the press elements.

In operation a length of cable is fed sequentially through the cable clamp, between the upper and lower press element and the cutter means. The cable is locked in position, by operation of the clamp and is cut by operation of the cutter means. The cable may then be moved rearwardly so that the cut end is positioned between the press elements. The apparatus is then operated as above to crimp a connector adjacent the cut end of the cable.

Desirably, operation of the cutter means and the clamp is controlled by the same control means as the apparatus so that sequential automatic operation can be achieved.

In another arrangement a cutter means may be provided in parallel between a pair of cooperating press elements, cable clamp being provided on the opposite side of each pair of press elements. The cutter operates as above allowing the simultaneous crimping of connectors adjacent each cut end.

From the foregoing it will be appreciated that many possible embodiments may be made of this invention without departing from the scope thereof. It is to be understood that all matter herein set forth or shown in the accompanying drawings is to be interpreted as illustrative and not in a limiting sense.

I claim:

1. A bandolier assembly for use in an apparatus for asembling a two-part electrical connector with an interposed cable, comprising;

a plurality of electrical connectors, each having a base and a cover, said base and said cover being pre-assembled in a manner defining a spacing therebetween for interposition of an electrical cable;

an elongate bandolier supporting said plurality of pre-assembled connectors in longitudinally spaced locations, said bandolier comprising two longitudinally extending films, each film having transversely spaced, longitudinally extending marginal edges, said films at least at each location where each said pre-assembled connector is supported being transversely spaced and defining therebetween an envelope containing one of said plurality of pre-assembled connectors, each envelope having openings at the marginal edges of said film for disposing said connectors therethrough, there being in registry with each envelope a projection extending into said each envelope and into said spacing between said cover and said base to maintain said spacing until said connector is assembled with said cable.

2. A bandolier assembly according to claim 1, wherein each film is made of relatively flexible plastic.

3. A bandolier assembly according to claim 2, wherein said films at spaced intervals along their respective lengths are drawn toward each other thereby defining a plurality of distinct, separate envelopes longitudinally along said bandolier.

4. A bandolier assembly according to claim 3, wherein two projections extends inwardly into each envelope in an opposing manner.

* * * * *